US010616678B2

(12) United States Patent
Shiner

(10) Patent No.: US 10,616,678 B2
(45) Date of Patent: Apr. 7, 2020

(54) TUNABLE BASS REFLEX CEILING MOUNTED SPEAKER SYSTEM

(71) Applicant: Crestron Electronics, Inc., Rockleigh, NJ (US)

(72) Inventor: Paul Shiner, Ringwood, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 0 days.

(21) Appl. No.: 16/100,452

(22) Filed: Aug. 10, 2018

(65) Prior Publication Data

US 2019/0349670 A1 Nov. 14, 2019

Related U.S. Application Data

(60) Provisional application No. 62/668,524, filed on May 8, 2018.

(51) Int. Cl.
*H04R 1/28* (2006.01)
*H04R 1/02* (2006.01)

(52) U.S. Cl.
CPC ..... *H04R 1/2819* (2013.01); *H04R 1/023* (2013.01); *H04R 1/025* (2013.01); *H04R 1/026* (2013.01); *H04R 1/2826* (2013.01); *H04R 2201/021* (2013.01); *H04R 2201/028* (2013.01); *H04R 2430/01* (2013.01)

(58) Field of Classification Search
CPC ..... H04R 1/2819; H04R 1/023; H04R 1/025; H04R 1/026; H04R 1/2826; H04R 2201/021; H04R 2201/028; H04R 2430/01
USPC ..... 381/349
See application file for complete search history.

(56) References Cited

U.S. PATENT DOCUMENTS 4,650,031 A 3/1987 Yamamoto
4,997,057 A * 3/1991 Furukawa ..... H04R 1/2826 181/156
5,286,928 A 2/1994 Borland
5,406,637 A 4/1995 Gonzalez
6,944,312 B2 9/2005 Mason
7,861,825 B2 1/2011 Stewart et al.
7,866,438 B2 1/2011 Stewart et al.
(Continued)

FOREIGN PATENT DOCUMENTS

JP 080186886 7/1998
WO 2016055687 4/2016

OTHER PUBLICATIONS

Bass Reflex, Wikipedia, last edited on Jul. 13, 2018, link:en.wikipedia.org/wiki/Bass_reflex.

(Continued)

*Primary Examiner* — Sean H Nguyen
(74) *Attorney, Agent, or Firm* — Crestron Electronics, Inc.

(57) ABSTRACT

A tunable bass reflex ceiling mounted speaker system and a method for tuning same is disclosed. In accordance with at least one embodiment, a speaker system is provided that includes a port tube and a transducer assembly within the interior volume of a back box. The transducer assembly generates a reflexive airwave within the interior volume of the back box. The reflexive airwave moves into and out of the interior volume through the port tube to create a better broadcast sound in a room. The port tube length has a fixed port and an adjustable port that is tunable by an adjustment mechanism.

27 Claims, 6 Drawing Sheets

(56) References Cited

U.S. PATENT DOCUMENTS

| | | | | |
|---|---|---|---|---|
| 8,091,681 | B2 | 1/2012 | Stewart et al. | |
| 8,109,360 | B2 | 2/2012 | Stewart et al. | |
| 8,127,885 | B2 | 3/2012 | Stewart et al. | |
| 8,256,566 | B1 * | 9/2012 | Rodgers | H04R 1/2826 181/144 |
| 8,276,706 | B2 | 10/2012 | Hudson et al. | |
| 8,286,749 | B2 | 10/2012 | Stewart et al. | |
| 8,297,402 | B2 | 10/2012 | Stewart et al. | |
| 8,353,384 | B2 | 1/2013 | Stewart et al. | |
| 8,439,153 | B2 | 5/2013 | Hudson et al. | |
| 8,443,930 | B2 | 5/2013 | Stewart et al. | |
| 8,479,871 | B2 | 7/2013 | Stewart et al. | |
| 8,631,897 | B2 | 1/2014 | Stewart et al. | |
| 8,672,087 | B2 | 3/2014 | Stewart et al. | |
| 8,720,640 | B2 | 5/2014 | Stewart et al. | |
| 8,893,849 | B2 | 11/2014 | Hudson et al. | |
| 2004/0213429 | A1 * | 10/2004 | Seidler | H04R 1/025 381/386 |
| 2005/0163334 | A1 * | 7/2005 | Suprapmo | H04R 1/2826 381/337 |
| 2007/0165895 | A1 * | 7/2007 | Matsumura | H04R 1/2803 381/351 |
| 2008/0169151 | A1 * | 7/2008 | Barrios | H04R 1/2819 181/156 |
| 2012/0177238 | A1 * | 7/2012 | Enamito | H04R 1/2819 381/349 |
| 2013/0195311 | A1 * | 8/2013 | Sahyoun | H04R 1/2834 381/395 |
| 2014/0093113 | A1 * | 4/2014 | Dix | H04R 1/2826 381/346 |
| 2014/0291065 | A1 * | 10/2014 | Kim | H04R 1/2826 181/199 |

OTHER PUBLICATIONS

2019_03_26_CP00416_01_International_Search_Rprt.
Genelec_Versatile_Mountings_installation_guide.
TOA_Wide_Disperson _Flush_Mount_Ceiling_Speaker.
NPL_Product_Spec_Sheets.

* cited by examiner

TUNABLE BASS REFLEX CEILING MOUNTED SPEAKER SYSTEM

BACKGROUND OF THE INVENTION

Technical Field

The embodiments described herein relate generally to speaker systems, and more specifically to systems, methods, and modes for creating a tunable, bass reflex, ceiling mounted speaker system comprising a transducer assembly, a port tube and an adjustment mechanism.

Background Art

There are many large buildings and spaces in which it is desirable to communicate to people located within. Many of these facilities utilize loudspeaker systems to broadcast audio and/or music to the people located therein. In many instances, the buildings can include large floor spaces—sometimes as much as several thousand or tens of thousands of square feet. In many of these locations, the space encompasses a suspended ceiling system, and the loudspeaker systems can be located in the ceiling system. The loudspeakers can then be located on a panel that can be interchanged with one or more of the typical mineral fiber-board ceiling tiles, and hard-wired or connected wirelessly to a broadcast audio system.

While setting up such a system is not overly complicated, broadcasting audio and/or music that is intelligible and reliably heard has proven to be a challenge. In many cases, the sound can be distorted because of highly reflective flooring, and in other cases, there are dead spots because the audio emission patterns of known, conventional speaker systems form null locations. In these null locations, the level of audio being broadcasted falls to very low levels. There are two ramifications as a result: if a person is in a first location, broadcast audio cannot be heard, and if a person is in a second location, the broadcast audio can be too loud. That is, patterns form of constructive interference (too loud), and destructive interference (too soft).

As those of skill in the art can appreciate, a bass reflex system (also known as a ported, vented box or reflex port) is a type of loudspeaker enclosure that uses a port (hole) or vent cut into the cabinet and a section of tubing or pipe affixed to the port. This port enables the sound from the rear side of the diaphragm to increase the efficiency of the system at low frequencies as compared to a typical closed box (Sealed-Box) loudspeaker or an infinite baffle mounting.

Use of a reflex port enhances the reproduction of the lowest frequencies generated by the woofer or subwoofer (e.g., greater frequency response, from low frequencies to higher frequencies). As those of skill in the art can appreciate, a reflex port generally consists of one or more tubes or pipes mounted in the front (baffle) or rear face of the enclosure. Depending on the exact relationship between driver parameters, the enclosure volume (and filling if any), and the tube cross-section and length, the efficiency and increased power handling can be substantially improved over the performance of a similarly sized sealed-box enclosure.

Though helpful with improving efficiency, bass reflex cabinets can have poor transient response compared to sealed enclosures at frequencies near the lower limit of performance, causing smearing or a longer resonance of the bass notes. Proper adjustment, by tuning, of the loudspeaker and port tube dimension, and matching with transducer assembly characteristics can reduce much of this problem.

Prior art systems are not described as satisfying physical constraints, including having a broadcast audio experience throughout a room while having a loudspeaker system less complicated to design and less expensive. Thus, a need has arisen for systems, methods, and modes for creating a tunable, bass reflex, ceiling mounted speaker system that overcomes the problems of prior art speaker systems.

SUMMARY OF THE INVENTION

It is an object of the embodiments to substantially solve at least the problems and/or disadvantages discussed above, and to provide at least one or more of the advantages described below.

It is therefore a general aspect of the embodiments to provide systems, methods, and modes for a tunable, bass reflex, ceiling mounted speaker system that will obviate or minimize problems of the type previously described.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

DISCLOSURE OF INVENTION

According to a first embodiment, the present invention provides a ceiling mounted speaker system for use within a room, that includes a back box, a transducer assembly and a port tube. The back box has an interior volume. Moreover, the transducer assembly sends primary broadcast sounds into the room and also generates a reflexive airwave within the interior volume of the back box. The port tube, that includes a fixed port, an adjustable port and an adjustment mechanism, is adapted to redirect the reflexive airwave, sent by the transducer assembly, into the room. The fixed port has a first end, being a port tube hole, that is open to the room and the fixed port has a second end. As for the adjustable port, it has a first end which is adjustably connected to the second end of the fixed port and the adjustable port also has a port tube entrance which is opened to the interior volume. Lastly, the adjustment mechanism is used for adjusting the length of the port tube.

In a further embodiment, the back box includes an access point to provide an access to the adjustment mechanism.

In a further embodiment, the ceiling mounted speaker system includes a mounting tape adapted to provide acoustical isolation.

In a further embodiment, the transducer assembly includes a mid-range coaxial speaker, a high-end tweeter dome, and a speaker mounting plate.

In a further embodiment, the port tube can be constructed from a material selected from a groups consisting of ABS plastics, fiberglass, and metal.

In a further embodiment, the port tube has a rectangular cross section or a circular cross section.

In a further embodiment, the port tube can be adapted to be acoustically tuned to a desired frequency response.

In a further embodiment, the type of the adjustment mechanism is threaded.

In a further embodiment, the adjustment mechanism can be a telescoping tube with a compression fit collar.

In a further embodiment, the speaker system can be covered by a decorative acoustic cover or by a modified ceiling tile which includes a thru collar that exposes the transducer assembly.

In a further embodiment, the speaker system includes an audio power amplifier in the interior volume of the back box and it is electrically connected to the transducer assembly. The audio power amplifier, in a further embodiment, includes a rechargeable battery.

According to a second embodiment, the present invention provides a ceiling mounted speaker system for use within a room that includes a steel back box, a transducer assembly and a port tube constructed in ABS plastic. The back box has an interior volume. Moreover, the transducer assembly sends primary broadcast sounds into the room and also generates a reflexive airwave within in the interior volume of the back box. The port tube, that includes a fixed port, an adjustable port and a threaded type adjustment mechanism, is adapted to redirect the reflexive airwave, sent by the transducer assembly, into the room. The fixed port has a first end, being a port tube hole, that is open to the room and the fixed port has also a second end. As for the adjustable port, it has a first end which is adjustably connected to the second end of the fixed port and the adjustable port also has a port tube entrance which is opened to the interior volume. Lastly, the length of the port tube is adjusted by using the threaded type adjustment mechanism.

In a further embodiment, the back box includes an access point to provide an access to the adjustment mechanism.

In a further embodiment, the ceiling mounted speaker system includes a mounting tape adapted to provide acoustical isolation.

In a further embodiment, the transducer assembly includes a mid-range coaxial speaker, a high-end tweeter dome, and a speaker mounting plate.

In a further embodiment, the port tube can be construed from a material selected from a groups consisting of fiberglass, and metal.

In a further embodiment, the port tube has a rectangular cross section.

In a further embodiment, the port tube can be adapted to be acoustically tuned to a desired frequency response.

In a further embodiment, the adjustment mechanism can be a telescoping tube with a compression fit collar.

In a further embodiment, the speaker system can be covered by a decorative acoustic cover or by a modified ceiling tile which includes a thru collar that exposes the transducer assembly.

In a further embodiment, the speaker system includes an audio power amplifier in the interior volume of the back box and it is electrically connected to the transducer assembly. The audio power amplifier, in a further embodiment, can be include a rechargeable battery.

According to a third embodiment, the present invention provides a method for spatial distribution of broadcast sound in a room via a ceiling mounted speaker system that includes a transducer assembly and a port tube. The length of the port tube is tuned according to the performance characteristics of the transducer assembly. The transducer assembly generates a reflexive airwave within the interior volume of the back box. The reflexive airwave moves into the port tube entrance and then the reflexive airwave moves through and out of the port tube via the port tube hole. Lastly, the reflexive airwave is diffused into a room.

In a further embodiment, the tuning step is performed by an adjustment mechanism.

In a further embodiment, the tuning step comprises selecting a port tube from a number of prefabricated port tubes. Moreover, each prefabricated port tube has a predetermined length.

In a further embodiment, the tuning step comprises cutting the port tube to a calculated length.

BRIEF DESCRIPTION OF THE DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

DETAILED DESCRIPTION OF THE INVENTION

Figure 1:
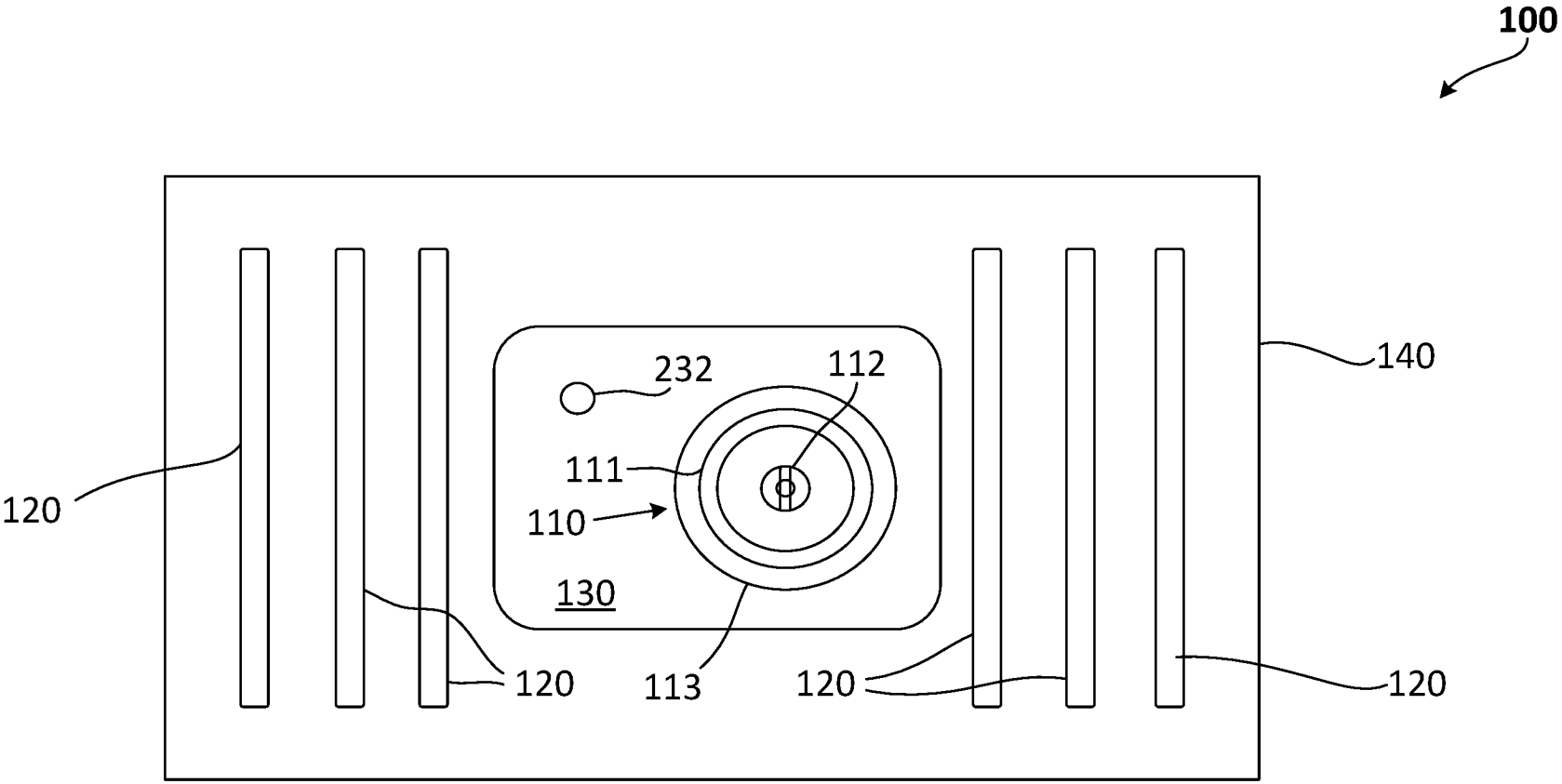
FIG. 1 illustrates a bottom view of the tunable, bass reflex, ceiling mounted speaker system according to an illustrative embodiment of the present invention.

The embodiments are described more fully hereinafter with reference to the accompanying figures. In the figures, the size and relative sizes of layers and regions may be exaggerated for clarity. Like numbers refer to like elements throughout. The detailed description that follows is written from the point of view of a control systems company, so it is to be understood that generally the concepts discussed herein are applicable to various subsystems and not limited to only a particular controlled device or class of devices, such as ceiling-based speaker systems, which include full and half ceiling panel speaker systems that are variably tunable and acoustically impedance matched.

Reference throughout the specification to "one embodiment" or "an embodiment" means that a particular feature, structure, or characteristic described in connection with an embodiment is included in at least one embodiment of the embodiments.

LIST OF REFERENCE NUMBERS FOR THE ELEMENTS IN THE DRAWINGS IN NUMERICAL ORDER

The following is a list of the major elements in the drawings in numerical order.

100 Ceiling Mounted Loudspeaker System (Speaker System)
110 Transducer Assembly
111 Low-to-Mid-range Coaxial (Coax) Speaker
112 High-end Tweeter Dome (Tweeter Speaker)
113 Speaker Mounting Plate (Mounting Plate)
120 Stiffeners
130 Baffle mount
140 Baffle plate
210 Back Box
211 Interior Volume
212 Room
213 Access Point
214 Acoustical Isolation and Mounting Tape (Mounting Tape)
221 Primary Broadcast Sound
222 Reflexive Airwave
230 Port Tube
231 Fixed Port
232 Port Tube Hole
233 Adjustable Port
234 Port tube entrance
235 Adjustment Mechanism
260 Rechargeable Battery
270 Decorative acoustic cover
410 Step of providing the ceiling mounted speaker system
420 Step of tuning the length of the port tube
430 Step of generating reflexive airwave
440 Step of moving reflexive airwave in port tube
450 Step of moving reflexive airwave out the port tube
460 Step of diffusing reflexive airwave in the room
501 Back Box Mounting Flange (Mounting Flange)

LIST OF ACRONYMS USED IN THE SPECIFICATION IN ALPHABETICAL ORDER

The following is a list of the acronyms used in the specification in alphabetical order.

L Length of the port tube
I Length of the adjustable port

MODE(S) FOR CARRYING OUT THE INVENTION

The different aspects of the embodiments described herein pertain to the context of ceiling-based speaker systems, which include full and half ceiling panel speaker systems that are variably tunable and acoustically impedance matched but is not limited thereto, except as may be set forth expressly in the appended claims.

Figure 6:
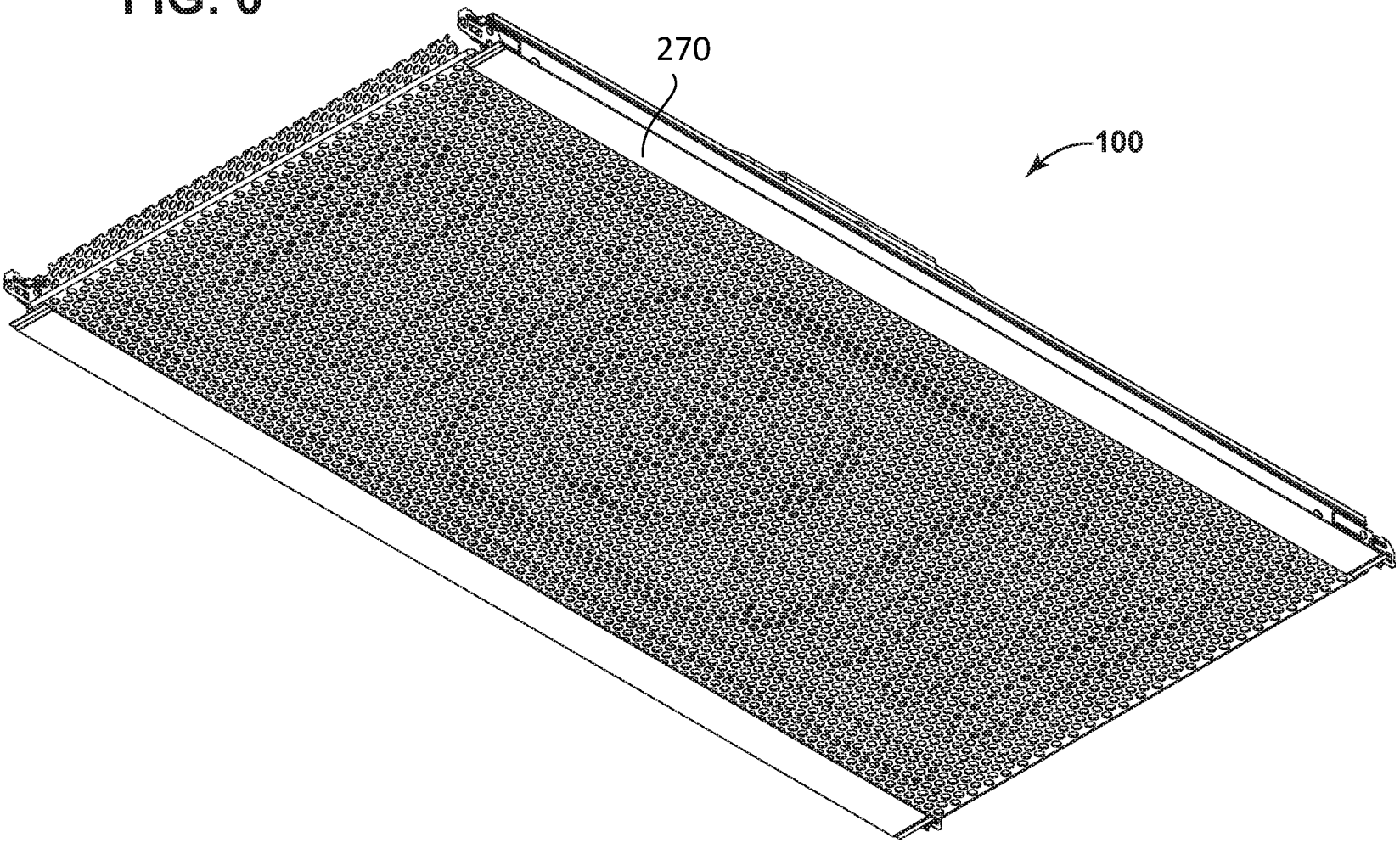
FIG. 6 illustrates an isometric bottom-left view of the ceiling mounted speaker system of FIG. 1, according to an illustrative embodiment of the present invention.

Referring to FIG. 1 that shows a bottom view of a tunable, bass reflex, ceiling mounted speaker system 100 when decorative acoustic cover 270 (shown in FIG. 6) is removed from speaker system 100. This is the view an observer might have when speaker system is installed in place of a mineral fiber board ceiling tile. As shown in FIG. 6, the decorative acoustic cover 270 can be a grille that covers the baffle plate 140. The baffle plate 140 can be also covered by a modified ceiling tile which includes a thru collar that exposes the transducer assembly 110. This kind of cover has esthetic properties and the color of the thru collar can be changed according to preference. Speaker system 100, shown in FIG. 1, approximates a rectangle, comprising a half-sized speaker system. Generally, ceiling panel speaker systems are full sized (2 feet×2 feet), or half sized (1 feet×2 feet). In the discussion that follows, however, the aspects of the embodiments are substantially interchangeable between the half and full-sized speaker systems. In addition, it can be appreciated by those of skill in the art that the aspects of the embodiments can equally apply to smaller and/or larger speaker systems, as well as metric sized speaker systems.

T-bar stringers may be used to provide rigidity as well as to facilitate placement of speaker system 100 within a suspended ceiling system. As those of skill in the art can appreciate, installers will locate fasteners, or some other similar mechanical device, in the upper ceiling, usually the joists, where the suspended ceiling is to be installed. Wire may be connected to the fasteners, and then to the T-bar stringer such that it is located at the correct height, substantially level with the adjoining and adjacent mineral-fiber ceiling tiles (most ceiling tiles exhibit acoustic dampening characteristics). T-bar stringers facilitate secure placement of speaker system 100 because in some cases, speaker system is one feet-by-two feet in dimension, which is one-half of a standard ceiling tile, and thus support is needed for the remaining ceiling tile and speaker system 100 according to aspects of the embodiments.

Baffle plate 140 is substantially planar, and relatively thin. Baffle plate 140 can be fabricated from metal, plastic, or fiberglass, or any combination thereof, including other materials known to those of skill in the art. Stiffeners 120, of which there can be one or more, are generally and typically fashioned as rectangular, three-dimensional indents in the substantially flat surface of baffle plate 140, and can include rounded corners, though that need not necessarily be the case. Note that the number of stiffeners 120 in the FIG. 1 is not meant to be taken in a limiting manner. Such stiffeners 120 provide a substantial amount of rigidity to baffle plate 140, as those of skill in the art can appreciate, and add very little cost, as stiffeners 120 can be simply pressed or formed into baffle plate 140. Although a detailed discussion of the theory of operation of stiffeners is both beyond the scope of this discussion, and not needed to understand the aspects of the embodiments, it is generally recognized that indentation stiffeners provide stiffness because the amount of force needed to bend a material increases substantially in the case of surfaces that are parallel to the bending force. In other words, if baffle plate 140 did not have stiffeners 120, only a relatively small amount of force would be needed to bend baffle plate 140, if applied parallel to its surface. Thus, the amount of flex and therefore resonance of baffle plate 140 is reduced through use of stiffeners 120 according to aspects of the embodiments. Advantageously, unwanted acoustical output is thereby reduced; the overall stiffness of baffle plate 140 is the dominant acoustical performance factor, according to aspects of the embodiments.

The amount of force needed to bend baffle plate 140 increases substantially when one or more stiffeners 120 are added with vertical walls that are substantially parallel to the applied force. In effect, the stiffeners 120 act to increase the thickness and therefore stiffness of baffle plate 140, but without a corresponding increase in the amount of material used to make baffle plate 140, thereby saving both material and weight (either of which decreases costs). While stiffeners 120 do increase the amount of material required to fabricate the baffle plate 140, this increase is not substantial.

Also shown in FIG. 1 are a port tube hole 232, a transducer assembly 110, and a baffle mount 130, upon which transducer assembly 110 and port tube 230 (shown in FIG. 2) are mounted, respectively. Baffle mount 130, according to an aspect of the embodiments, can be fabricated from the same material as baffle plate 140, although that need not necessarily be the case. Baffle mount 130 can be mounted to baffle plate 140 through any one or more of a variety or means, including, but not limited to, screws, nuts and bolts, rivets, removal and/or non-removable glue/adhesives, and other fasteners, as can be appreciated by those of skill in the art. According to aspects of the embodiments, port tube 230 (FIG. 2) can be glued to hole 232, and according to further aspects of the embodiments, port tube 230 can be fastened using any one of the means described above in regard to baffle plate 140, or other means, as known by those of skill in the art.

According to one embodiment, transducer assembly 110 comprises a mid-range coaxial speaker (coax speaker) 111, a high-end tweeter dome (tweeter) 112, and a mounting plate 113, among other components, as known to those of skill in the art. Typically, though not necessarily, and not to be taken in a limiting manner, tweeter 112 and coax speaker 111 can be purchased as a unit, as this design is well known to those of skill in the audio arts. The mechanical frame upon which coax speaker 111 and tweeter 112 are mounted can then be fastened to mounting plate 113, which can be mounted to baffle plate 140. Such fastenings can be accomplished through one or more of the means discussed above in regard to baffle mount 130 and baffle plate 140, and different mounting means can be used for the different mountings according to aspects of the embodiments.

Transducer assembly 110 is mounted on mounting plate 113, in the manner described above, and mounting plate 113 is mounted on to baffle plate 140, in the manner as described above.

Figure 2:
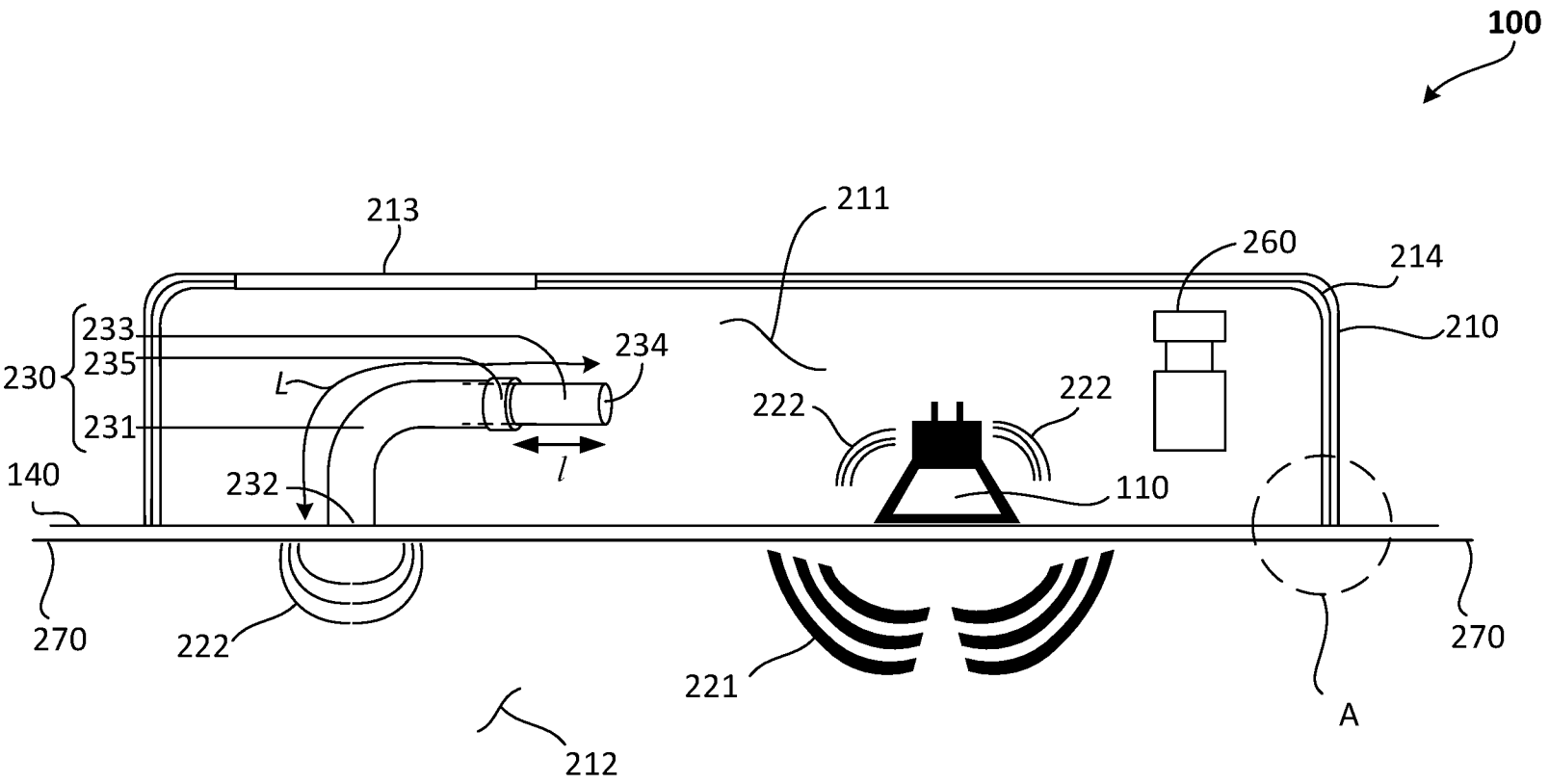
FIG. 2 illustrates a partially cross sectional side view of the tunable, bass reflex, ceiling mounted speaker system, shown in FIG. 1, according to an illustrative embodiment of the present invention.

Referring now to FIG. 2, shown is a partially cross sectional side view of the speaker system showing a cross sectional view of port tube 230, which is mounted to interface with port tube hole 232 in the manner as described above. Also shown in FIG. 2 is a reflexive airwave 222, which is generated by transducer assembly 110, and the air that is moved out of, and into, port tube 230 according to aspects of the embodiments. Primary broadcast sound 221 is transmitted from transducer assembly 110 into the room 212.

Port tube 230 can be fabricated from one or more of many different types of materials, including, but not limited to plastics, fiberglass, and/or metal. According to preferred aspects of the embodiments, port tube 230 is substantially tubular in shape, and has a substantially circular cross section. According to further aspects of the embodiments, however, other shapes for port tube 230 can be used, such as a rectangular cross section, among others.

According to aspects of the embodiments, port tube 230 comprises several dimensions that facilitate its function of receiving reflexive airwave 222, and transmitting the same as a port tube transfer airwave according to aspects of the embodiments. Reflexive airwave 222 is the air that is moved by the transducer assembly 110. As those of skill in the art can appreciate, although the discussion and description above references air as moving in one direction only—i.e., from the interior volume 211 of the back box 210 out through port tube 230, air moves in both directions; that is, as the transducer assembly 110 move outwards, into room 212, a partial vacuum is created and air is drawn in through port tube 230 into interior volume 211 of the back box 210. When the transducer assembly 110 move inwards, the air in interior volume 211 is compressed, and exits outwardly through port tube 230 into the room 212.

Port tube 230, as shown in FIG. 2, can be adjusted in total length L through use of an adjustable port 233. That is, the total length L of port tube 230 can be adjustable by an adjustment length I. The adjustable port 233 is adjustably connected to the fixed port 231, and includes a port tube entrance 234 opening to the interior volume 211. Port tube 230 may be adjustable by fitting the adjustable port 233 into the fixed port 231, for example by a telescoping fit. The ports 233 and 231 can be maintained in place using the adjustment mechanism 235. For example, the adjustment mechanism 235 can comprise compression fit collar to prevent the telescoping tubes 233 and 231 from movement. In other embodiments, a different type adjustment mechanism, can be used. For example, a threaded adjustment mechanism may be used where the adjustable port 233 is threadably connected to the fixed port 231 such that when adjustable port 233 is screwed in one direction, the length of the tube port shortens and if it is unscrewed in the other direction, the length of the tube port lengthens.

Transducer assembly 110 creates primary broadcast sound 221 in a manner well known to those of skill in the art. Primary broadcast sound 221 is the sound intended to be broadcast by each of coax speaker 111 and tweeter speaker 112.

According to aspects of the embodiments, back box 210 and interior volume 211 trap the reflexive airwave 222 that is produced by transducer assembly 110. The port tube 230 provides a tunable port to allow ancillary reflexive airwave 222 to move in and out of interior volume 211 to create a better broadcast experience. According to aspects of the embodiments, the better broadcast experience is one in which a better spatial distribution of broadcast sound occurs within the room 212 such that both the number and severity of "dead" zones in which levels of broadcast sound drops is reduced.

Figure 3:
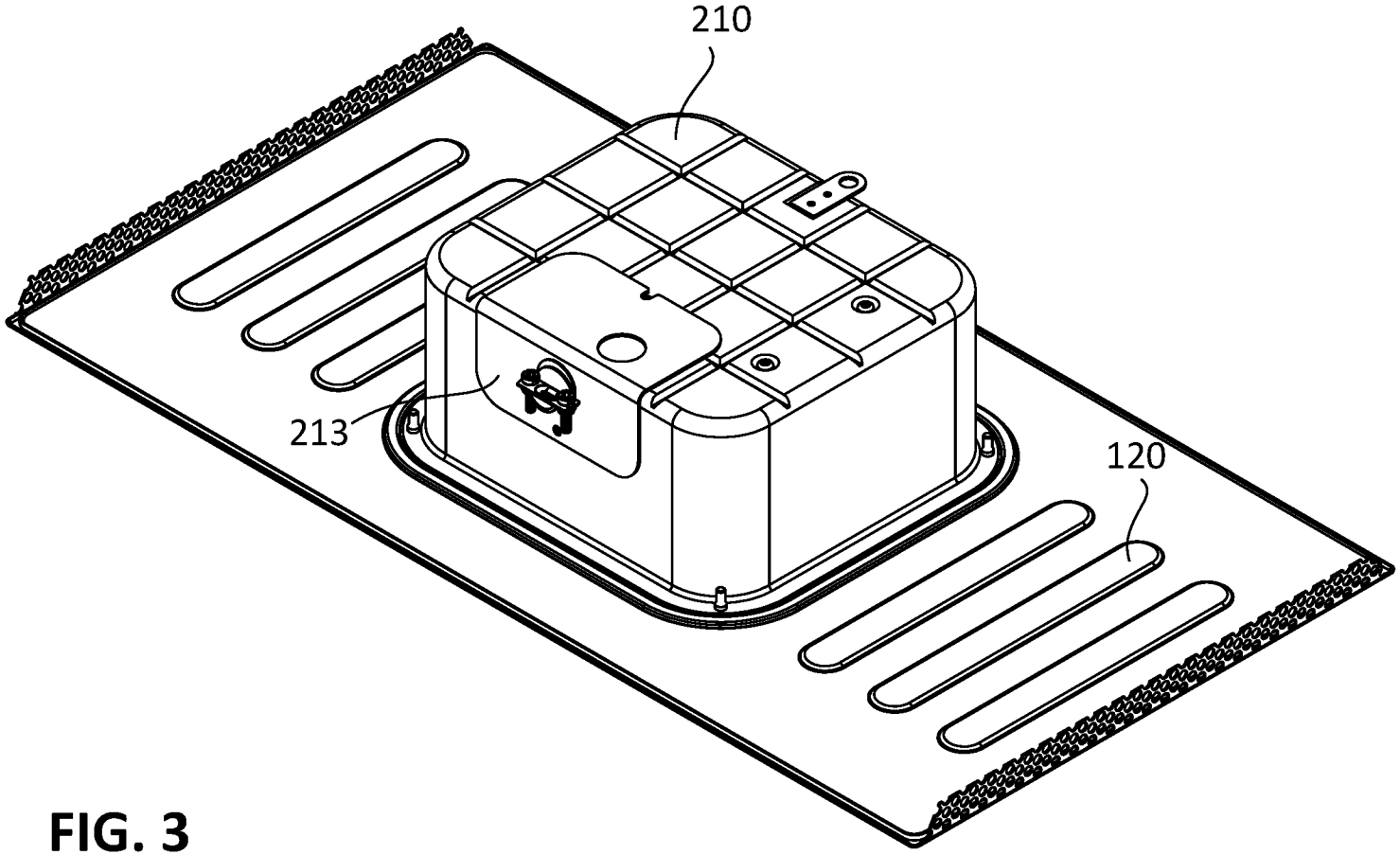
FIG. 3 illustrates an isometric top view of the tunable, bass reflex, ceiling mounted speaker system shown in FIG. 1, according to an illustrative embodiment of the present invention.

As can be seen in FIGS. 2 and 3, back box 210 has a relative shallow depth to it (about 3 inches to 4 inches), when viewed in comparison to its width (generally one or two feet) and length (about two feet). Even though there is a relatively shallow depth, a relatively large volume can be achieved by the relatively larger length and width dimensions. Advantageously, this larger volume accords better performance of port tube 230 and transducer assembly 110. According to aspects of the embodiments, implementation of about a 90° bend in port tube 230 provides a substantially longer length than would otherwise be possible if no bend were implemented, because of the shallowness of back box 210. Use of adjustable port 233, in combination with fixed port 231, provides a means for adjusting an overall length of port tube 230, which allows for fine tuning of the frequency response of the reflex speaker system 100. In a preferred embodiment, a user can fine tune the length of port tube 230 through use of adjustment access point 213, located on the top of the back box 210. The user can open the access point 213, and loosen adjustment mechanism 235 to move adjustable part 233 to increase or decrease the length L of port tube 230 as needed. Once the proper length has been determined, adjustment mechanism 235 can then be tightened to keep port tube 230 at the desired length.

As can be seen in the respective accompanying figures, back box 210 comprises rounded corners. Such rounded corners facilitate the reduction of standing waves within room 212 according to aspects of the embodiments. Further still, dampening material can be included within back box 210 to facilitate the suppression or reduction of standing waves within room 212. Such dampening materials can include spun Dacron, a material that is known to have sound-dampening qualities.

For different applications, with different transducer assemblies 110, different dimensions, such as diameters, lengths and cross-sectional areas, of port tubes 230 can be used. If interior volume 211 of the back box 210 changes, a different port tube 230 can be used to maintain a substantially similar bandwidth. According to further aspects of the embodiments, use of port tube 230 and port tube hole 232, along with transducer assembly 110 spatially distributes broadcast sound in a more even fashion, such that a more constant sound pressure level is maintained over a greater area in room 212 according to aspects of the embodiments.

Figure 5:
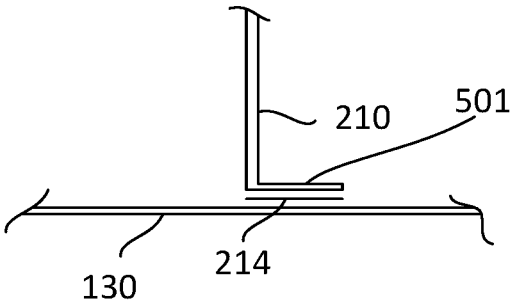
FIG. 5 illustrates an exploded view of section A as shown in FIG. 2, according to an illustrative embodiment of the present invention

As shown in FIG. 2 and FIG. 5, mounting tape 214 can be used to secure back box 210 to baffle plate 140. Mounting tape 214 can be located between back box mounting flange 501 and an upper surface of baffle mount 130. In addition, as its name suggests, and according to further aspects of the embodiments, mounting tape 214 provides acoustical isolation between interior volume 211 of back box 210 and any space that surrounds speaker system 100, such that reflexive airwaves 222 are substantially prevented from escaping from, or entrancing into, the room 212 except through port tube 230. In addition, mounting tape 214, or a material with substantially similar characteristics can be used around access point 213.

According to further aspects of the embodiments, rechargeable battery 260 can be included within interior volume 211, with appropriate circuitry, to provide power to transducer assembly 110, as-needed. Rechargeable battery 260 can be recharged using power-over-Ethernet, in a trickle charge arrangement. Typically, the power available from rechargeable battery 260 will only be needed infrequently, so that a trickle charge arrangement can be used to keep rechargeable battery 260 sufficiently charged.

According to further aspects of the embodiments, speaker system 100 can further be used as part of an emergency voice repeater system. According to still further aspects of the embodiments, speaker system 100 can include one or more audio power amplifiers that can be used to amplify the output to produce greater power out of transducer assembly 110, and thereby increase the volume. According to further aspects of the embodiments, additional components that can be included in speaker system 100, but which are not shown, can include network interfaces, frequency bridges, additional drivers and ports, among other devices. According to still further aspects of the embodiments, a bridge can be used to secure the high-end tweeter dome 112 to the mid-range coaxial speaker 111, and in other cases, a post can be used to facilitate the same mounting.

As those of skill in the art can further appreciate, speaker system 100 can be incorporated into a larger audio/video/security system, such that important audio announcements can be broadcast substantially simultaneously over large areas.

As may have been discussed in regard to the figures, reference is made to several dimensions, including several radii, angles, height, among others. Those of skill in the art can appreciate that although examples of dimensions are provided, these should not be taken in a limiting manner; that is, the aspects of the embodiments are not to be construed as defined or limited by the specific example of the dimensions shown and discussed, but instead are provided merely for illustrating an example of what a device that incorporates the aspects of the embodiments could, in a non-limiting manner, look like.

Furthermore, as those of skill in the art can appreciate, since the aspects of the embodiments are directed towards a physical object, with dimensional characteristics, all of the parts will have various dimensions, some of which are not shown in fulfillment of the dual purposes of clarity and brevity.

According to still further aspects of the embodiments, some of these objects will have dimensional characteristics that lend themselves to aesthetic aspects; in fulfillment of the dual purposes of clarity and brevity, dimensions in this regard have also been omitted. Therefore, as the aspects of the embodiments are directed towards ceiling-based speaker systems, which include full and half ceiling panel speaker systems that are variably tunable and acoustically impedance matched it is to be understood that the dimensions of the different objects, some dimensions shown, some dimensions not shown, will be understood by those of skill in the art.

Figure 4:
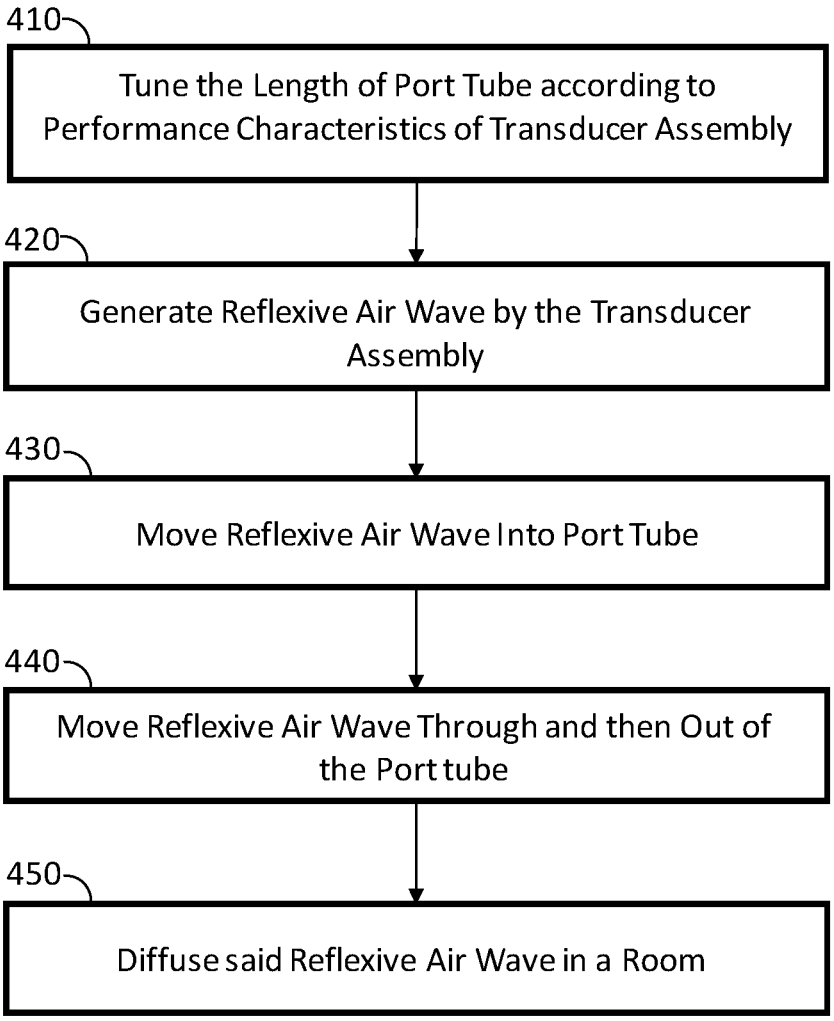
FIG. 4 is a flow chart of a method for providing spatial distribution using the ceiling mounted speaker system of FIG. 2, according to an illustrative embodiment of the present invention

FIG. 4 is a flow chart of a method for providing spatial distribution of broadcast sound in a room via a ceiling mounted speaker system that includes a transducer assembly and a port tube, in accordance with at least one embodiment. The method begins in step 410, where the length of the port tube is tuned according to the performance characteristics of the transducer assembly. A variety of tuning methods can be employed, for example, but not limited to adjusting, the weight, the length, the shape and/or the size of the port tube. In step 420, the transducer assembly acts to generate a reflexive airwave in the interior volume of the back box. In step 430, the reflexive airwave is moved into the port tube entrance from the interior volume of the back box. In step 440, the reflexive airwave is moved through and then out of the port tube via the port tube hole. In step 450, the reflexive airwave is diffused into the room to create a better broadcast experience.

In further embodiments the step of tuning 410 is accomplished in a variety of ways. In a first further embodiment, tuning of the port tube length is done by an adjustment mechanism as discussed above. In a second embodiment tuning of the port tube length is done by selecting a port tube from a number of prefabricated port tubes, each having a predetermined length. In a third embodiment tuning of the port tube length may be done by cutting the port tube to a calculated length.

ALTERNATE EMBODIMENTS

Alternate embodiments may be devised without departing from the spirit or the scope of the invention. For example, speaker system could be equipped with multiple port tubes and/or multiple transducer assemblies.

What is claimed is:

1. A ceiling mounted speaker system for use within a room, said system comprising:

a back box including an interior volume;

a transducer assembly sending primary broadcast sound into the room and generating a reflexive airwave within the interior volume;

a port tube adapted to redirect the reflexive airwave into the room, said port tube comprising:

a fixed port having a first end being a port tube hole that is open to the room, and a second end, an adjustable port having a first end adjustably connected to said second end of the fixed port, and a port tube entrance opens to the interior volume; and an adjustment mechanism for adjusting the length of the port tube; and an access point to provide access to the adjustment mechanism located within the interior volume of the back box.

2. The system according to claim 1, further comprising:

a mounting tape adapted to provide acoustical isolation.

3. The system according to claim 1, wherein the transducer assembly comprises:

a mid-range coaxial speaker, a high-end tweeter dome, and a speaker mounting plate.

4. The system according to claim 1, wherein the port tube is constructed from a material selected from a group consisting of ABS plastics, fiberglass, and metal.

5. The system according to claim 1, wherein the port tube has a rectangular cross section.

6. The system according to claim 1, wherein the port tube has a circular cross section.

7. The system according to claim 1, wherein the port tube is adapted to be acoustically tuned to a desired frequency response.

8. The system according to claim 1, wherein adjustment mechanism is a threaded type.

9. The system according to claim 1, wherein adjustment mechanism is a telescoping tube with a compression fit collar.

10. The system according to claim 1, further comprising:

a decorative acoustic cover.

11. The system according to claim 1, further comprising:

a modified ceiling tile which includes a thru collar that exposes the transducer assembly.

12. The system according to claim 1, further comprising:

an audio power amplifier electrically connected to the transducer assembly.

13. The system according to claim 12, further comprising:

a rechargeable battery.

14. A ceiling mounted speaker system for use within a room, said system comprising:

a steel back box including an interior volume;

a transducer assembly sending primary broadcast sound into the room and generating a reflexive airwave within the interior volume;

a port tube made up of ABS plastic with a circular cross section adapted to redirect the reflexive airwave into the room, the port tube comprising:

a fixed port having a first end being a port tube hole that is open to the room, and a second end, an adjustable port having a first end adjustably connected to the second end of the fixed port, and a port tube entrance opens to the interior volume; and a threaded type adjustment mechanism for adjusting the length of the port tube; and an access point to provide access to the adjustment mechanism located within the interior volume of the back box.

15. The system according to claim 14, further comprising:

a mounting tape adapted to provide acoustical isolation.

16. The system according to claim 14, wherein the transducer assembly comprises:

a mid-range coaxial speaker, a high-end tweeter dome, and a speaker mounting plate.

17. The system according to claim 14, wherein the port tube is constructed from a material selected from a group consisting of fiberglass, and metal.

18. The system according to claim 14, wherein the port tube has a rectangular cross section.

19. The system according to claim 14, wherein the port tube is adapted to be acoustically tuned to a desired frequency response.

20. The system according to claim 14, wherein adjustment mechanism is a telescoping tube with a compression fit collar.

21. The system according to claim 14, further comprising:

a decorative acoustic cover.

22. The system according to claim 14, further comprising:

a modified ceiling tile which includes a thru collar that exposes the transducer assembly.

23. The system according to claim 14, further comprising:

an audio power amplifier electrically connected to the transducer assembly.

24. The system according to claim 23, further comprising:

a rechargeable battery.

25. A method for providing spatial distribution of broadcast sound in a room via a ceiling mounted speaker system including a transducer assembly and a fixed port tube, the method comprising:

tuning the length of the port tube according to the performance characteristics of the transducer assembly;

generating a reflexive airwave within an interior volume of the speaker system by the transducer assembly;

moving said reflexive airwave into a port tube entrance from the interior volume;

moving said reflexive airwave through and then out of the port tube via the port tube hole; and diffusing said reflexive airwave into a room, and wherein the step of tuning is performed using an adjustment mechanism located within the interior volume of the speaker system.

26. The method according to claim 25, wherein the step of tuning comprises selecting a port tube from a number of prefabricated port tubes, each having a predetermined length.

27. The method according to claim 25, wherein the step of tuning comprises cutting the port tube to a calculated length.

* * * * *